US006848400B2

(12) United States Patent
Gaessler et al.

(10) Patent No.: US 6,848,400 B2
(45) Date of Patent: Feb. 1, 2005

(54) GAS EXCHANGE VALVE MECHANISM FOR AN INTERNAL COMBUSTION ENGINE

(75) Inventors: Hermann Gaessler, Vaihingen (DE); Udo Diehl, Stuttgart (DE); Karsten Mischker, Leonberg (DE); Rainer Walter, Pleidelsheim (DE); Juergen Schiemann, Markgroeningen (DE); Christian Grosse, Kornwestheim (DE); Volker Beuche, Stuttgart (DE); Stefan Reimer, Markgroeningen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 10/258,215

(22) PCT Filed: Feb. 14, 2002

(86) PCT No.: PCT/DE02/00522

§ 371 (c)(1),
(2), (4) Date: Feb. 10, 2003

(87) PCT Pub. No.: WO02/066796

PCT Pub. Date: Aug. 29, 2002

(65) Prior Publication Data

US 2004/0035378 A1 Feb. 26, 2004

(30) Foreign Application Priority Data

Feb. 19, 2001 (DE) ..... 101 07 698

(51) Int. Cl.[7] ..... F01L 9/02

(52) U.S. Cl. ..... 123/90.12; 123/90.15

(58) Field of Search ..... 123/90.12, 90.13, 123/90.15

(56) References Cited

U.S. PATENT DOCUMENTS 6,223,846 B1 * 5/2001 Schechter ..... 180/165
6,308,690 B1 * 10/2001 Sturman ..... 123/508
6,321,703 B1 * 11/2001 Diehl et al. ..... 123/90.12

FOREIGN PATENT DOCUMENTS

DE 37 39 891 A 6/1989
DE 198 26 047 A 12/1999
DE 199 35 871 A 2/2001

* cited by examiner

*Primary Examiner*—Thomas Denion
*Assistant Examiner*—Zelalem Eshete
(74) *Attorney, Agent, or Firm*—Ronald E. Greigg

(57) ABSTRACT

A gas exchange valve device for an internal combustion engine is provided with a hydraulic apparatus which includes a fluid circuit and at least one pressure reservoir connected to the fluid circuit and containing piston prestressed by a device, and also includes a controllable actuating device. A gas exchange valve is also provided, whose valve element is acted on by the actuating device. In order to achieve a simpler design of the gas exchange valve device the pressure reservoir is disposed so that in an approximately unpressurized state of the pressure reservoir, its piston at least indirectly locks the valve element of the gas exchange valve in an essentially closed position.

20 Claims, 3 Drawing Sheets

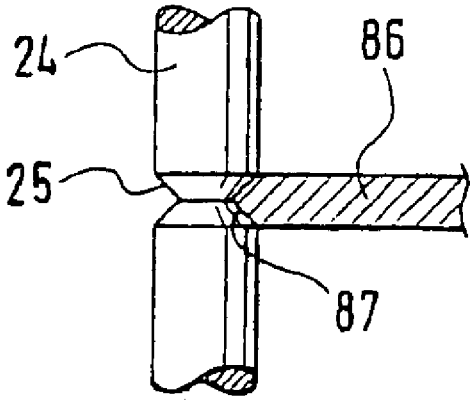
Fig. 3
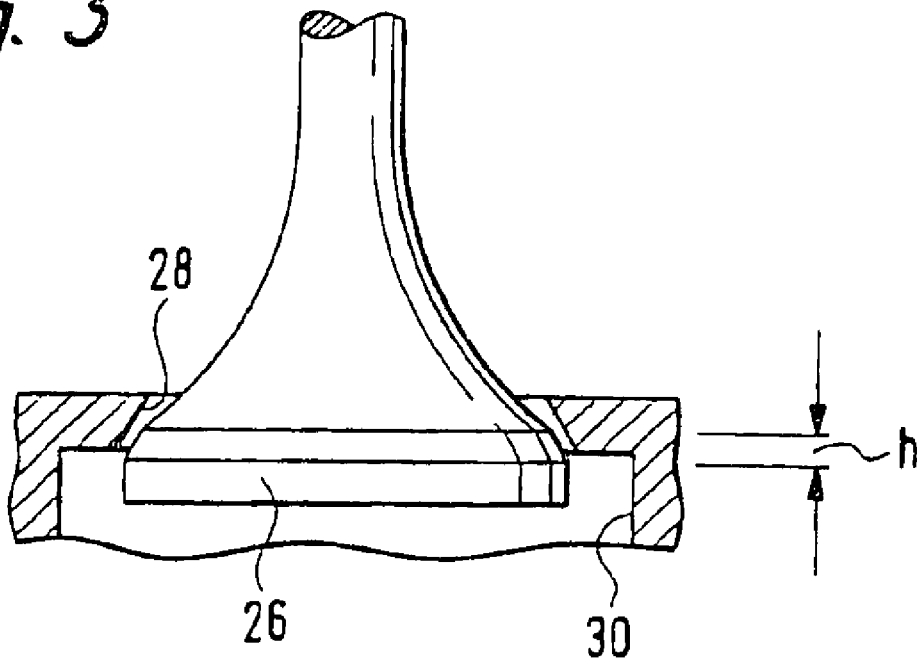

GAS EXCHANGE VALVE MECHANISM FOR AN INTERNAL COMBUSTION ENGINE

CROSS-REFERENCE TO RELATED APPLICATIONS

This application is a 35 USC 371 application of PCT/DE 02/00522, filed on Feb. 14, 2002.

BACKGROUND OF THE INVENTION

1. Field of the Invention

The current invention relates to a gas exchange valve device for an internal combustion engine, in particular of a motor vehicle, having a hydraulic apparatus, which includes a fluid circuit and at least one pressure reservoir connected to the fluid circuit and containing a piston prestressed by a device, and also includes a controllable actuating device, and having a gas exchange valve whose valve element is acted on by the actuating device.

2. Description of the Prior Art

A gas exchange valve device of the above kind is known from DE 198 26 047 A1. Such a gas exchange valve device is used when the internal combustion engine has no camshaft. An engine of this kind has the advantage that the control times for the inlet and outlet valves are independent of the position of the piston of the respective cylinder. Depending on the operating state of the engine, for example at a high speed, and depending on the torque desired by the driver, valve opening and closing times can be achieved, which permit an operation of the engine that is particularly optimized in terms of emissions and consumption.

The known hydraulic apparatus functions with a hydraulic circuit, which is supplied from a hydraulic reservoir by means of a high-pressure hydraulic pump. The actuating device has a hydraulic piston, which can be acted on in both movement directions and is connected to the valve shaft of the valve element of a gas exchange valve. By means of 2/2-on/off valves, one of the two chambers of a hydraulic cylinder can be acted on with a higher pressure, which leads to a corresponding movement of the piston and therefore of the valve element in the engine block.

The hydraulic circuit is connected to a hydraulic pressure reservoir, which is embodied as a spring-loaded piston reservoir and is used to damp oscillations in the hydraulic system. Furthermore, a similarly embodied emergency pressure reservoir is connected to one of the two chambers of the hydraulic cylinder, and in the event of a decrease of the pressure in the hydraulic line, supplies enough pressure and fluid volume so that the valve can be moved into its closed neutral position. The two pressure reservoirs function with different pressure levels, which are set by the differing rigidities of their restoring springs.

When there is a slight leakage in hydraulic circuit, if the engine to be supplied is turned off for a long period of time, then it is possible for both of the pressure reservoirs to empty out completely, which results in a complete pressure relief of the hydraulic circuit. In order to be able to keep the valve element of the gas exchange valve in the closed position even in this instance, the known gas exchange valve device is provided with an emergency closing spring, which pushes the piston of the actuating device and therefore also the valve element into the closed position in the absence of hydraulic pressure.

This assures that when the engine is restarted, the valve element does not protrude into the combustion chamber in such a way that it can collide, for example with other valve elements or even with the piston of the engine that is moving in the combustion chamber. The disadvantage of such an emergency closing spring, however, is that it is provided solely for this one special purpose and has no function otherwise. In addition, integrating the emergency closing spring into the gas exchange valve device can be problematic due to lack of available space. Finally, the emergency closing spring increases the hydraulic pressure required to open the valve element of the gas exchange valve since its closing force must also be overcome. Therefore, a higher hydraulic pressure and consequently a higher energy consumption are required in order to open the gas exchange valve during normal operation.

The object of the current invention, therefore, is to modify a gas exchange valve device of the type mentioned at the beginning in such a way that it can be produced more simply and inexpensively and can be operated with the lowest possible energy costs.

This object is attained in a gas exchange valve device of the type mentioned at the beginning in that the pressure reservoir is disposed so that in an approximately unpressurized state of the pressure reservoir, its piston at least indirectly locks the valve element of the gas exchange valve in an essentially closed position.

SUMMARY OF THE INVENTION

The invention is based on the fact that the pressure reservoir is embodied so that in the event of a decrease of the hydraulic pressure in the fluid circuit, the pressure reservoir can always supply a sufficient fluid volume so that the actuating device can move the valve element of the gas exchange valve into an essentially closed position. In order to supply this fluid volume, the piston of the pressure reservoir moves toward its unpressurized neutral position due to its initial stress. It reaches this position when the fluid circuit and therefore also the pressure reservoir are essentially unpressurized.

According to the invention, this movement of the valve element of the pressure reservoir is also used for the locking process of the valve element: namely, the pressure reservoir is disposed so that its piston releases the valve element of the gas exchange valve when the fluid circuit exerts pressure on the piston and pushes it out of its neutral position. In such an operating state, in which the fluid circuit and consequently also the pressure reservoir are pressurized, the valve element can move freely and as a result, the engine can also be operated in a normal fashion.

By contrast, if the pressure in the fluid circuit falls to a value below the normal operating pressure, then the spring action on the piston pushes the hydraulic fluid out of the pressure reservoir and the actuating device closes the valve element of the gas exchange valve. According to the invention, however, the pressure reservoir is disposed so that when the piston reaches its unpressurized neutral position and consequently no fluid volume can be supplied from the pressure reservoir in order to close the valve element or keep it in its closed position, the piston locks the valve element of the gas exchange valve in this essentially closed position.

With the gas exchange valve device according to the invention, an emergency closing spring is no longer required since the piston of the pressure reservoir performs the function of locking the valve element of the gas exchange valve in an essentially closed position in the event of a pressure loss. The gas exchange valve device according to the invention can consequently be produced more simply and inexpensively. Moreover, less hydraulic pressure is required to move the valve element into an open position since no forces other inertial forces of the valve element need be overcome.

Advantageous modifications of the invention are also disclosed.

A first modification discloses that the piston of the pressure reservoir acts at least indirectly on a valve shaft of the valve element of the gas exchange valve in the approximately unpressurized state of the pressure reservoir. The valve shaft of the valve element generally has a certain length, which allows the pressure reservoir to be positioned with relatively little trouble so that its piston can act on the valve shaft. However, it is also, for example, conceivable for the piston of the pressure reservoir to act directly on the actuating device and e.g. for it to lock the piston of the hydraulic cylinder in a particular position there.

In this case, it is particularly preferable for a contact surface at least indirectly connected to the piston of the pressure reservoir and a contact surface at least indirectly connected to the valve element of the gas exchange valve to cooperate with frictional engagement in the approximately unpressurized state of the pressure reservoir. In general, only very slight forces are required to lock the valve element of the gas exchange valve in position. Depending on the installation position of the engine and of the gas exchange valve, it is only necessary to prevent the valve element of the gas exchange valve from moving out of the closed position into the open position merely by means of its own weight. This prevention is possible by means of a simple frictional engagement. An engagement of this kind can be very simply and inexpensively produced.

It is possible for the contact surface at least indirectly connected to the piston of the pressure reservoir and/or the contact surface at least indirectly connected to the valve element of the gas exchange valve to be embodied in the form of a friction surface or surfaces. This allows the frictional engagement and consequently the possible holding force to be improved in a simple manner.

Furthermore, the contact surface at least indirectly connected to the piston of the pressure reservoir can cooperate in a positively engaging manner with the contact surface at least indirectly connected to the valve element of the gas exchange valve in the approximately unpressurized state of the pressure reservoir. This embodiment is possible alternatively to or in addition to the frictional engagement mentioned above. A positive engagement permits an even more reliable locking of the valve element in the desired position.

In one such particularly preferred modification of the gas exchange valve according to the invention, the valve shaft of the valve element of the gas exchange valve is provided with a recess in which an engaging section at least indirectly connected to the piston of the pressure reservoir engages in the approximately unpressurized state of the pressure reservoir. Such a positive engagement can be easily and inexpensively achieved. Naturally, it is also conceivable for the reverse to be true, namely, that a recess in a part connected to the piston moves onto a protrusion provided on the valve shaft of the valve element. It should also be noted at this point that it is equally possible for there to be a positively engaging connection with the actuating device, which actuates the valve element.

The recess can be disposed so that the gas exchange valve is locked in a slightly open position in the approximately unpressurized state of the pressure reservoir. This has the advantage of facilitating the starting of the internal combustion engine. The reason for this is that the starter of the engine only has to overcome the inertial moments of the moving parts and does not have to perform any secondary work since the compression work required for the pressure buildup in the hydraulic circuit only has to be exerted when the engine is operating. Naturally it should be noted that the position of the valve element in which the locking takes place is selected so that there is no danger of the valve element either colliding with the piston moving in the combustion chamber of the engine or colliding with the valve elements of other gas exchange valves.

One simple possibility for using the movement of the piston to lock the valve element in place is comprised in that the piston of the pressure reservoir is connected to a locking rod, which acts on the valve element of the gas exchange valve in the approximately unpressurized state of the gas exchange valve.

BRIEF DESCRIPTION OF THE DRAWINGS

Exemplary embodiments of the invention will be explained in detail below in conjunction with the accompanying drawings, in which:

FIG. 3 shows a partial section through a valve element and a pressure reservoir of a second exemplary embodiment of a gas exchange valve device of an internal combustion engine.

DESCRIPTION OF THE EXEMPLARY EMBODIMENTS

Figure 1:
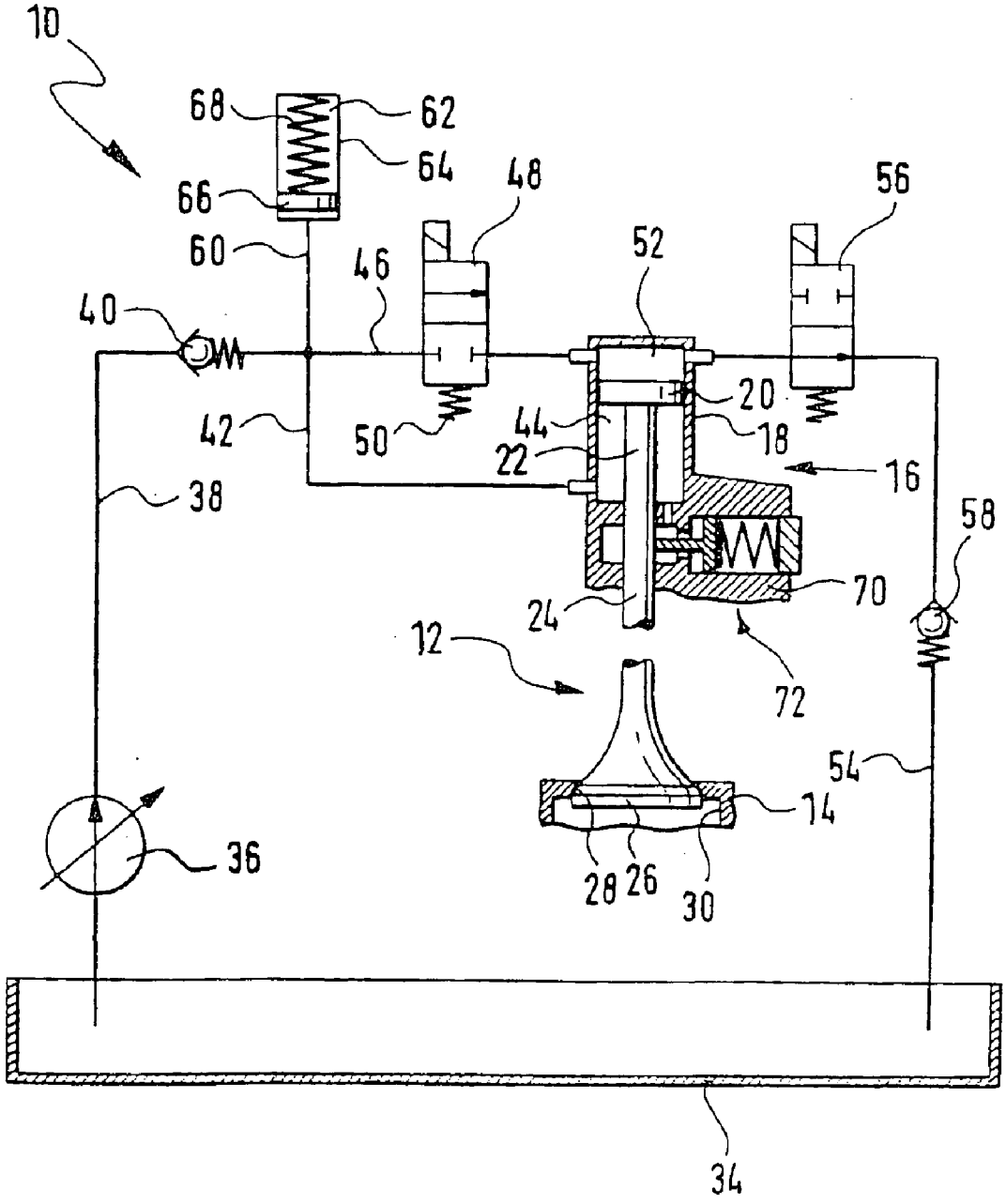
FIG. 1 shows a schematic representation of a first exemplary embodiment of a gas exchange valve device of an internal combustion engine.

In FIG. 1, a gas exchange valve device is labeled as a whole with the reference numeral 10. It includes a gas exchange valve, which in this instance is embodied as an inlet valve 12 of an internal combustion engine 14.

A hydraulic cylinder 16 actuates the inlet valve 12. This cylinder includes a housing 18 in which a piston 20 is guided in a sliding faction by means of a piston rod 22. The piston rod 22 passes through the housing 18 and is connected to a valve shaft 24, which in turn has a disk-shaped valve element 26 formed onto it. A region of the surface of the valve shaft 24 is embodied as a friction surface 25 (see FIG. 2). When the inlet valve 12 is closed, the valve element 26 rests tightly against a valve seat 28 in the upper region of a combustion chamber 30 of the internal combustion engine 14.

The gas exchange valve device 10 also has a reservoir 34 from which hydraulic fluid is supplied by a high-pressure pump 36 into a high-pressure hydraulic line 38. Downstream of a check valve 40, the high-pressure hydraulic line 38 splits into a branch 42, which feeds directly into a lower working chamber 44 of the hydraulic cylinder 16 in FIG. 1 (the terms "above" and "below" in this description only refer to the depiction in the figures; naturally the parts of the gas exchange device 10 can be installed in any arbitrary position). Another branch 46 of the high-pressure hydraulic line 38 leads to a 2/2-on/off valve 48, which a spring 50 presses into its closed position in the currentless state. Downstream of the 2/2-on/oft valve 48, the branch 46 of the high-pressure hydraulic line 38 leads to an upper working chamber 52 of the hydraulic cylinder 16 in FIG. 1. From there, a high-pressure hydraulic line 54 leads back to the reservoir 34 by means of an additional 2/2-on off valve 56 and a check valve 58. The 2/2-on/off valve 56 is open in the currentless state.

A branch line 60, which is connected to a pressure reservoir 62, is also connected to the point at which the high-pressure hydraulic line 38 splits into the branch 42 and the branch 46. The pressure reservoir 62 has a housing 64 that contains a mobile piston 66. A spring 68 acts on the piston 66 toward the end of the pressure reservoir 62, which is connected to the branch line 60. The rigidity and spring path of the spring 68 are selected so that the pressure reservoir 62 can function as an oscillation damper for pressure fluctuations occurring in the hydraulic lines 38, 42, 46, and 54.

Figure 2:
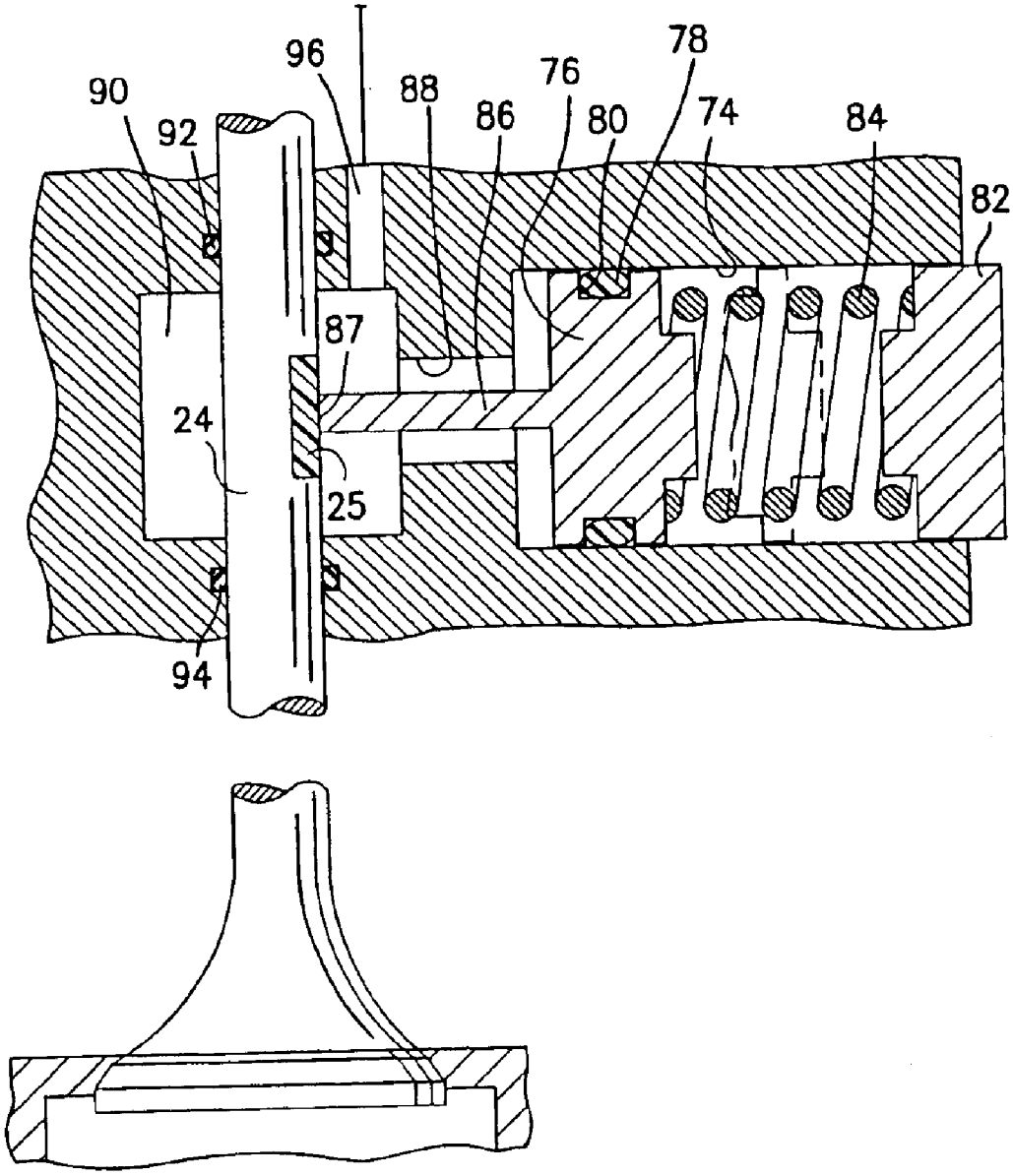
FIG. 2 shows a partial section through a region of the gas exchange valve device from FIG. 1, with a valve element and a pressure reservoir.

The housing 18 of the hydraulic cylinder 16 has a housing 70 of another pressure reservoir 72 formed onto it. FIG. 2 shows the embodiment of this additional pressure reservoir 72 in detail.

The housing 70 contains a cavity 74, which contains a mobile piston 76. The outer circumference surface of the piston 76 is sealed in relation to the inner wall of the cavity 74 by means of a sealing ring 78, which rests in an annular groove 80 in the outer circumference surface of the piston 76. The cavity 74 is sealed in relation to the outside by a cover 82. The cover 82 is provided with a ventilation opening that is not shown in the drawing. A helical spring 84 is clamped between the cover 82 and the piston 76 and pushes the piston 76 to the left in FIG. 2.

The piston 76 has a locking rod 86 formed onto it, which in the unpressurized state of the pressure reservoir 72 depicted in FIG. 2, extends through an opening 88 into a working chamber 90. The valve shaft 24 of the valve element 26 of the inlet valve 12 also passes through the working chamber 90, extending perpendicular to the longitudinal axis of the piston 76 and the locking rod 86. Sealing rings 92 and 94 seal it in relation to the working chamber 90. The axial end of the locking rod 86 oriented toward the valve shaft 24 is embodied as a friction surface. A branch line 96 leads from the working chamber 90 to the lower working chamber 44 of the hydraulic cylinder 16.

The helical spring 84 of the pressure reservoir 72 is less rigid and has a longer spring path that the spring 68 of the pressure reservoir 62. By contrast with the pressure reservoir 62, the pressure reservoir 72 therefore does not function as an oscillation damper, but as an emergency pressure reservoir, which as explained in detail below, in the event of a pressure drop in the hydraulic lines 38, 42, 46, and 54, supplies of fluid volume that is sufficient to move the valve element 26 of the inlet valve 12 into its closed position.

The gas exchange valve device 10 shown in FIGS. 1 and 2 functions in the following manner:

The high-pressure pump 36 delivers hydraulic fluid from the reservoir 34 into hydraulic line 38 and from there, via the branch line 42 into the lower working chamber 44 of the hydraulic cylinder 16. If the on/off valve 48 is open and the on/off valve 56 is closed, then the upper working chamber 52 of the hydraulic cylinder 60 is also pressurized by the hydraulic fluid. Since the engagement surface in the axial direction is greater on the top of the piston 20 than on the bottom, in this instance, the piston 20 is pushed downward and the inlet valve 12 is opened.

If the on/off valve 48 is closed and the on/off valve 56 is open, then the upper working chamber 52 is connected to the ambient pressure by means of the branch line 54, as a result of which the piston 20 is moved upward again and the inlet valve 12 is closed. In this manner, very rapid opening and closing times of the inlet valve 12 can be achieved without requiring a mechanical triggering of the inlet valve 12, for example by means of a camshaft of the internal combustion engine 14.

During normal operation, when high-pressure pump 36 delivers fluid into the high-pressure line 38, the pressure prevailing in the lower working chamber 44 of the hydraulic cylinder 16 is transmitted into the cavity 74 of the pressure reservoir 72 by means of the branch line 96, the working chamber 90, and the opening 88. The rigidity of the helical spring 84 is selected so as to allow it to be compressed by the piston 76 in this instance as a result of the pressure prevailing in the cavity 74 so that the piston 76 moves toward the right into the position depicted with dashed lines in FIG. 2.

In this position, the friction surface 87 of the locking rod 86 is spaced distinctly apart from the friction surface 25 on the valve shaft 24. Consequently, the valve shaft 74 can freely move the valve element 26 and the piston 20 of the hydraulic cylinder 16 can freely move the piston rod 22. Since neither the piston 20 nor the valve element 26 is pressed into the one or the other position by a spring, only a slight hydraulic force is required to move the valve element 26.

If the pressure in the hydraulic lines 38, 42, 46, and 54 decreases, for example because the internal combustion engine 14 has been turned off, the high-pressure pump 36 is therefore no longer delivering, and there is a leakage in the hydraulic circuit, then the pressure in the cavity 74 of the pressure reservoir 72 also decreases as a result. With the decreasing pressure, the helical spring 84 can push the piston 76 of the pressure reservoir 72 toward the left in FIG. 2. The hydraulic fluid stored in the cavity 74 is therefore displaced into the lower working chamber 44 by means of the opening 88, the working chamber 90, and the branch line 96. Once there, the incoming hydraulic fluid pushes the piston 20 of the hydraulic cylinder 16 upward again.

It should be remembered that when the engine 14 is turned off, the on/off valve 56 is without current and open and the upper working chamber 52 of the hydraulic cylinder 16 is therefore unpressurized. As a result, the piston rod 22 and the valve shaft 24 move the valve element 26 up again and press it against the valve seat 28; the work of the piston 76 of the pressure reservoir 72 thus finally brings the valve element 26 into its closed position.

When the pressure in the cavity 74 decreases to the ambient pressure, i.e. the pressure reservoir 72 is unpressurized, the piston 76 reaches its furthermost position toward the left, which is defined by virtue of the fact that the friction surface on the end of the locking rod 86 oriented away from the piston 76 presses against the friction surface 25 on the valve shaft 24 of the valve element 26. The spring path of the helical spring 84 is selected so that even in this position of the piston 76 of the pressure reservoir 72, the helical spring 84 is not completely relaxed; i.e. it still exerts a force on the piston 76.

The length of the locking rod 86 in turn is selected so that when its friction surface 87 rests against the friction surface 25 of the valve shaft 24, the piston 76 does not yet come into contact with the defining wall of the cavity 74 on the left in FIG. 2. Therefore, the helical spring 84 finally presses the friction surface 87 of the locking rod 86 against the friction surface 25 on the valve shaft 24 and thus produces a frictional engagement between these two elements.

This frictional engagement prevents the valve shaft 24 from being able to move in the axial direction. This in turn means that the valve element 26 is locked in the closed position. In the gas exchange valve device 10 shown in FIGS. 1 and 2, it is therefore assured that when the system is unpressurized, the valve element 26 is locked in a position in which the inlet valve 12 is closed. This locking in the gas exchange valve device 10 is achieved without additional components, e.g. an emergency closing spring. The gas exchange valve device 10 can therefore be easily and inexpensively produced. Moreover, the piston 20 of the hydraulic cylinder 16 is not prestressed, which results in the fact that during normal operation of the gas exchange valve device 10, a comparatively low hydraulic force is required to move the piston 20 of the hydraulic cylinder 16.

The discussion will now center on FIG. 3, which depicts a region of a second exemplary embodiment of a gas exchange valve device 10. Those parts whose function is equivalent to elements shown in FIGS. 1 and 2 are provided with the same reference numerals. They will not be discussed in further detail.

By contrast with the exemplary embodiment shown in FIGS. 1 and 2, no friction surface is provided on the valve shaft 24 shown in FIG. 3. Instead, a circumferential, V-shaped annular groove 25 is let into the valve shaft 24. Analogous to this, the end of the locking rod 86 oriented toward the valve shaft 24 is also not provided with a friction surface, but has a tip 87, whose edges have the same inclination as the V-shaped annular groove in the valve shaft 24. When the pressure reservoir is unpressurized, the tip 87 of the locking rod 86 engages in the annular groove 25 in the valve shaft 24 and thereby locks the valve element 26 in a definite position.

The axial position of the annular groove 25 in the valve shaft 24 is selected so that when the tip 87 of the locking rod 86 engages in the annular groove 25 in the valve shaft 24, the inlet valve 12 is not completely closed, but is slightly open. This means that the valve element 26 is lifted up from the valve seat 28. In order to prevent the valve element 26 from colliding with the piston (not shown) moving in the combustion chamber 30 of the internal combustion engine 14 or colliding with other valve elements, the annular groove 25 in the valve shaft 24 is positioned so that the opening stroke h of the valve element 26 is approximately 0.5 to 1.0 mm.

In an exemplary embodiment that is not shown, the gas exchange valve device does not have a separate pressure reservoir for the oscillation damping. Instead, the oscillation damping function is integrated into the pressure reservoir that locks the valve element in place in the unpressurized state. This is achieved by virtue of the fact that the prestressing device contained in it functions in two stages: in a harder region of the prestressing device, it performs the oscillation damping function, in a softer region, it performs the emergency pressure function and the locking function. This can be achieved, for example, by connecting two springs with different rigidities in series with each other.

The foregoing relates to preferred exemplary embodiments of the invention, it being understood that other variants and embodiments thereof are possible within the spirit and scope of the invention, the latter being defined by the appended claims.

We claim:

1. In a gas exchange valve device (10) for an internal combustion engine (12), in particular of a motor vehicle, having a hydraulic apparatus (15), which includes a fluid circuit (38, 42, 46, 54) and at least one pressure reservoir (62, 72) connected to the fluid circuit (38, 42, 46, 54) and containing a piston (66, 76) prestressed by device (68, 84), and also includes a controllable actuating device (16), and having a gas exchange valve (12) whose valve element (26) is acted on by the actuating device (16), the improvement wherein the pressure reservoir (72) is disposed so that in an approximately unpressurized state of the pressure reservoir (72), its piston (76) at least indirectly locks the valve element (26) of the gas exchange valve (12) in an essentially closed position, and that the pressure reservoir is embodied so that in the event of a decrease of the hydraulic pressure in the fluid circuit, the pressure reservoir can supply a sufficient fluid volume so that the actuating device can move the valve element of the gas exchange valve into an essentially closed position.

2. The gas exchange valve device (10) according to claim 1 wherein, in the approximately unpressurized state of the pressure reservoir (72), the piston (76) of the pressure reservoir (72) acts at least indirectly on a valve shaft (24) of the valve element (26) of the gas exchange valve (12).

3. The gas exchange valve device (10) according to claim 1 wherein a contact surface (87) at least indirectly connected to the piston (76) of the pressure reservoir (72) and a contact surface (25) at least indirectly connected to the valve element (26) of the gas exchange valve (12) cooperate in a frictionally engaging fashion in the approximately unpressurized state of the pressure reservoir (72).

4. The gas exchange valve device (10) according to claim 2 wherein a contact surface (87) at least indirectly connected to the piston (76) of the pressure reservoir (72) and a contact surface (25) at least indirectly connected to the valve element (26) of the gas exchange valve (12) cooperate in a frictionally engaging fashion in the approximately unpressurized state of the pressure reservoir (72).

5. The gas exchange valve device according to claim 3 wherein the contact surface at least indirectly connected to the piston (76) of the pressure reservoir (72) and/or the contact surface at least indirectly connected to the valve element (26) of the gas exchange valve (12) are embodied in the form of a friction surface or surfaces (25, 87).

6. The gas exchange valve device according to claim 4 wherein the contact surface at least indirectly connected to the piston (76) of the pressure reservoir (72) and/or the contact surface at least indirectly connected to the valve element (26) of the gas exchange valve (12) are embodied in the form of a friction surface or surfaces (25, 87).

7. The gas exchange valve device according to claim 1 wherein the contact surface (87) at least indirectly connected to the piston (76) of the pressure reservoir (72) and/or the contact surface (25) at least indirectly connected to the valve element (26) of the gas exchange valve (12) cooperate in a positively engaging fashion in the approximately unpressurized state of the pressure reservoir (72).

8. The gas exchange valve device according to claim 2 wherein the contact surface (87) at least indirectly connected to the piston (76) of the pressure reservoir (72) and/or the contact surface (25) at least indirectly connected to the valve element (26) of the gas exchange valve (12) cooperate in a positively engaging fashion in the approximately unpressurized state of the pressure reservoir (72).

9. The gas exchange valve device according to claim 3 wherein the contact surface (87) at least indirectly connected to the piston (76) of the pressure reservoir (72) and/or the contact surface (25) at least indirectly connected to the valve element (26) of the gas exchange valve (12) cooperate in a positively engaging fashion in the approximately unpressurized state of the pressure reservoir (72).

10. The gas exchange valve device according to claim 4 wherein the contact surface (87) at least indirectly connected to the piston (76) of the pressure reservoir (72) and/or the contact surface (25) at least indirectly connected to the valve element (26) of the gas exchange valve (12) cooperate in a positively engaging fashion in the approximately unpressurized state of the pressure reservoir (72).

11. The gas exchange valve device according to claim 7 wherein a recess (25) is provided in the valve shaft (24) of the valve element (26) of the gas exchange valve (12) and an engaging section (87) is at least indirectly connected to the piston (76) and engages in the recess (25) in the approximately unpressurized state of the pressure reservoir (72).

12. The gas exchange valve device according to claim 2 wherein a recess (25) is provided in the valve shaft (24) of the valve element (26) of the gas exchange valve (12) and an engaging section (87) is at least indirectly connected to the piston (76) and engages in the recess (25) in the approximately unpressurized state of the pressure reservoir (72).

13. The gas exchange valve device according to claim 3 wherein a recess (25) is provided in the valve shaft (24) of the valve element (26) of the gas exchange valve (12) and an engaging section (87) is at least indirectly connected to the piston (76) and engages in the recess (25) in the approximately unpressurized state of the pressure reservoir (72).

14. The gas exchange valve device according to claim 5 wherein a recess (25) is provided in the valve shaft (24) of the valve element (26) of the gas exchange valve (12) and an engaging section (87) is at least indirectly connected to the piston (76) and engages in the recess (25) in the approximately unpressurized state of the pressure reservoir (72).

15. The gas exchange valve device according to claim 7 wherein a recess (25)is provided in the valve shaft (24) of the valve element (26) of the gas exchange valve (12) and an engaging section (87) is at least indirectly connected to the piston (76) and engages in the recess (25) in the approximately unpressurized state of the pressure reservoir (72).

16. The gas exchange valve device according to claim 7 wherein the recess (25) is disposed so that the gas exchange valve (12) is locked in a slightly open position in the approximately unpressurized state of the pressure reservoir (72).

17. The gas exchange valve device according to claim 1 wherein the piston (76) of the pressure reservoir (72) is connected to locking rod (86), which acts on the valve element (26) of the gas exchange valve (12) in the approximately unpressurized state of the gas exchange valve (12).

18. The gas exchange valve device according to claim 4 wherein the piston (76) of the pressure reservoir (72) is connected to locking rod (86), which acts on the valve element (26) of the gas exchange valve (12) in the approximately unpressurized state of the gas exchange valve (12).

19. The gas exchange valve device according to claim 11 wherein the piston (76) of the pressure reservoir (72) is connected to locking rod (86), which acts on the valve element (26) of the gas exchange valve (12) in the approximately unpressurized state of the gas exchange valve (12).

20. The gas exchange valve device according to claim 16 wherein the piston (76) of the pressure reservoir (72) is connected to locking rod (86), which acts on the valve element (26) of the gas exchange valve (12) in the approximately unpressurized state of the gas exchange valve (12).

* * * * *